US007090154B2

(12) United States Patent
Herring

(10) Patent No.: US 7,090,154 B2
(45) Date of Patent: Aug. 15, 2006

(54) TAP

(75) Inventor: William Peter Herring, Somerset (GB)

(73) Assignee: Hornbeam Ivy Limited, Somerset (GB)

( * ) Notice: Subject to any disclaimer, the term of this patent is extended or adjusted under 35 U.S.C. 154(b) by 261 days.

(21) Appl. No.: 10/347,349

(22) Filed: Jan. 21, 2003

(65) Prior Publication Data

US 2003/0146307 A1 Aug. 7, 2003

(30) Foreign Application Priority Data

Jan. 24, 2002 (GB) ..... 0201604

(51) Int. Cl.
*B05B 1/30* (2006.01)

(52) U.S. Cl. ..... 239/569; 239/444; 239/442; 239/282; 239/283; 137/801

(58) Field of Classification Search ..... 239/531, 239/530, 569, 281, 445, 576; 137/801
See application file for complete search history.

(56) References Cited

U.S. PATENT DOCUMENTS

,384,129 A 6/1888 Coe
384,129 A * 6/1888 Koe ..... 144/212
2,216,149 A * 10/1940 Weiss ..... 248/75
4,827,538 A * 5/1989 Heimann et al. ..... 4/677
4,827,539 A * 5/1989 Kiziah ..... 4/252.4
4,889,168 A * 12/1989 Kerzich et al. ..... 138/103
D384,129 S * 9/1997 Neufeld et al. ..... D23/213
5,749,179 A * 5/1998 Bohacik ..... 52/127.2
5,758,690 A * 6/1998 Humpert et al. ..... 137/801
6,550,079 B1 * 4/2003 Gransow et al. ..... 4/567

FOREIGN PATENT DOCUMENTS

JP 090032065 A * 2/1997

* cited by examiner

*Primary Examiner*—David A. Scherbel
*Assistant Examiner*—James S. Hogan
(74) *Attorney, Agent, or Firm*—Stites & Harbison PLLC; Ross F. Hunt, Jr.

(57) ABSTRACT

A tap has a flexible hose for delivering water and a support for the flexible hose. The support comprises a channel with an open mouth along its length. The flexible hose is removably mounted in the channel such that it is supported along at least the majority of its length and can be removed by lifting out of the mouth of the channel. When removed from its support the flexible hose extends the reach of the tap, and when mounted in the support it is kept in an orderly position where it does not interfere with e.g. washing and cooking. The tap can be wall or deck mounted. Preferably the channel is U-shaped and has a semi-circular cross section, which conforms to the shape of the hose. The hose may have a spray head at its distal end.

3 Claims, 4 Drawing Sheets

TAP

The present invention relates to a tap comprising a body having a fluid flow path therethrough, and a valve or valves for regulating the flow of fluid through the body. Usually one or more handles control the valve or valves, so that a user can regulate the flow of fluid via a handle.

Some types of tap have an ordinary spout and a separate flexible hose connected to the tap body and in communication with the fluid flow path by means of a diverter—so that the water can pass either through the spout or through the hose. A spray head is connected to the end of the flexible hose where water exits. The hose can be secured by an attachment (e.g. a deck attachment), which holds the spray head in position but allows most of the hose to hang loose. The hose may be detached from the attachment to extend the reach of the spray head and direct water where required.

Other taps are known where the flexible hose passes through the spout tube and is reversibly fixed to it. A spray head may be attached to the end of the flexible hose through which water exits. In a typical arrangement, the flexible hose loops under the kitchen sink (or down from any other surface on which the tap is mounted) and then returns through the spout, where it rests in position or is reversibly fixed to an attachment on the spout. The flexible hose can be pulled up from beneath when required to extend the reach of the spray head. In this position the spray head is more mobile and the spout has a greater effective use, so that water can be directed where required. A weight on the hose pulls the hose back down to return it to the resting position. This keeps the disorderly hose out of the way of a person using the sink.

Unfortunately, the pull out spray type of tap can be mounted only on surfaces where it is practical and possible for the flexible hose to be looped down. There may not be sufficient space under a horizontal deck for the flexible hose to be stored. The pull out spray tap is also unsuitable for mounting on a wall, because the length of hose dangling beneath the tap would be inconvenient and unsightly.

At its most general, the present invention proposes that a tap has a flexible hose which is releasably mounted in a support channel, with the channel extending along at least the majority of the length of the hose, and the hose being liftable out of the channel.

Thus, the present invention provides a tap comprising:

a body having a fluid flow path therethrough;

at least one valve for regulating the flow of fluid through the body;

a flexible hose that communicates with the fluid flow path; and a support comprising a channel with an open mouth along the length of the channel;

the hose being removably mounted in the channel of the support such that the hose is supported along at least the majority of the length of the hose by the support and the hose is liftable out of the mouth to remove it from the channel.

Usually the valve will be connected to at least one corresponding handle, for controlling the valve.

The present invention has the advantage of a flexible hose which can be used for extending the reach of the tap when the hose is removed from its support. When it is not being used to extend the reach of the tap, the hose can be mounted on its support to keep it in an orderly position where it does not interfere with e.g. washing and cooking. When mounted on the support, the hose can function as a simple fixed spout. Unlike the pull out spray tap, the present invention can be wall- or deck-mounted and is suitable for use in places where a dangling length of flexible hose is impractical.

The support is preferably attached to the body of the tap, e.g. by a pivot joint. The support may then extend above the body of the tap and then return towards the body in a U-shaped curve in the working position. Normally, only one end of the support would be attached to the body.

The support preferably extends along the whole length of the flexible hose. However, it is possible for one end of the hose to be unsupported by the support. The length of the support may thus be less than, but is preferably not greater than, the length of the flexible hose.

The tap may have a rigid head at the free end of the hose (i.e. the end distal from the tap body). The rigid head can overlap the end of the support channel, and may, for example, be a spray head.

Preferably, a clip releasably attaches the rigid head to the support. Alternatively, the free end of the hose may be clipped to the support.

The shape of the channel preferably conforms to the shape of the flexible hose. Thus, assuming the hose is circular in cross section, the channel will be in the shape of an arc of a circle in cross section. Other shapes of channel are possible, but have the disadvantage that the hose may then be able to move laterally in the channel. To ensure that the hose may easily be lifted out of the channel, the mouth of the channel will preferably be not narrower than the maximum width of that part of the hose in the channel, to prevent the hose having to force open the mouth of the channel when it is removed or replaced. Thus, if the hose is circular in cross section, the channel forms an arc extending not more than 180° in cross section. The channel may be semi-circular in cross section.

Although the hose is releasable from the support over the majority of its length, the channel may extend only along part of the hose and there may be a part of the hose which is not so releasable from the support. The hose will normally be releasable at the end of the support remote from the tap body, and for the majority of the length of the hose from this end. Thus, the channel may extend from the end of the support furthest from the tap body and along the whole length of the support. However, it is preferable that at the end of the support nearer the tap body, the support extends wholly around the hose in order to hold the hose in place.

The present invention is preferably a 'mixer tap' for water, in which the body comprises a mixed water chamber where water from two sources can be combined before it exits the tap. One source of water is normally heated, and the flow and proportion of hot and cold water into the mixed water chamber is regulated by one or more valves. The mixer tap is thus used to control the temperature of water leaving the tap.

Embodiments of the present invention will now be described, with reference to the drawings, in which FIG. 1 is a wall mounted tap;

Figure 1:
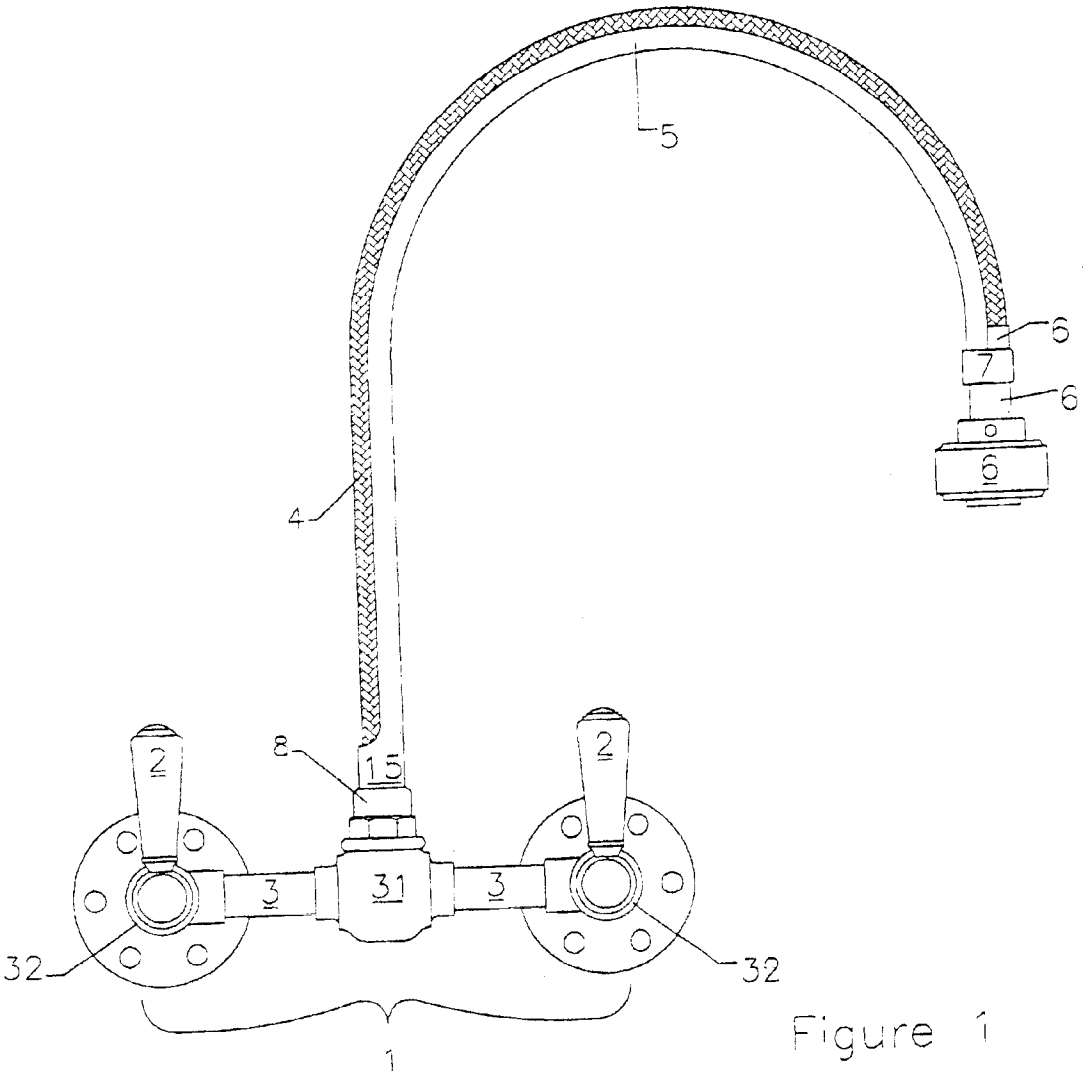

The embodiment shown in FIG. 1 is a wall mounted tap which has a body (1) comprising a central part (31) containing a mixing chamber, two valve chambers (32) on respective sides of the central part, and two pipes (3) which connect the valve chambers (32) to the central part (31). The body (1) may be cast as a single piece. Each valve chamber contains a valve connected to an external handle (2).

Hot and cold water pipes may be attached to respective valve chambers (32), and would approach the tap from behind in FIG. 1. The valves are operated by the handles (2) in order to regulate the flow and proportion of hot and cold water through respective valve chambers (32) and into the mixing chamber. One end of a flexible hose (4) is connected to the mixing chamber, and when a valve is open, water flows through the valve chamber, into the mixing chamber and out through the flexible hose (4). An elongate support (5) extends from the central part (31) of the body (1) in the form of a U-shaped curve. The support (5) comprises a channel that is semi-circular in cross-section, except for a short stretch (15) nearest the point where it joins the body (1), where it is closed along its length. The flexible hose (4) passes through this tubular stretch (15) of the support (5) after it exits the water chamber, and then nestles in the channel formed by the support (5). The tubular stretch (15) of the support (5) guides the hose (4) into the channel and prevents it from buckling out. The support (5) and the flexible hose (4) are substantially the same length, and the support (5) supports the full length of flexible hose (4) that is exposed. The flexible hose (4) is connected to a rigid head (6) mounted on the end of the hose distal from the tap body. The rigid head (6) overlaps the channel of the support (5), one end of it lying in the channel and the rest extending out of the channel. The rigid head (6) comprises a spray head or other outlet at the end distal from the tap body, so that a flow of water exits the tap through the head. The rigid head (6) is reversibly attached to the support (5) by a clip (7), which holds the flexible hose in the channel. The clip (7) can be released and the hose (4) lifted out to extend the reach of the spray head and manually direct the spray of water. In some embodiments, the spray head may be removable from the hose (4) or have other flow options in order to produce a single jet of water rather than a spray. The support (5) is joined to the body (1) by a pivot (8), which allows the support (5) to be rotated around a vertical axis.

Figure 2:
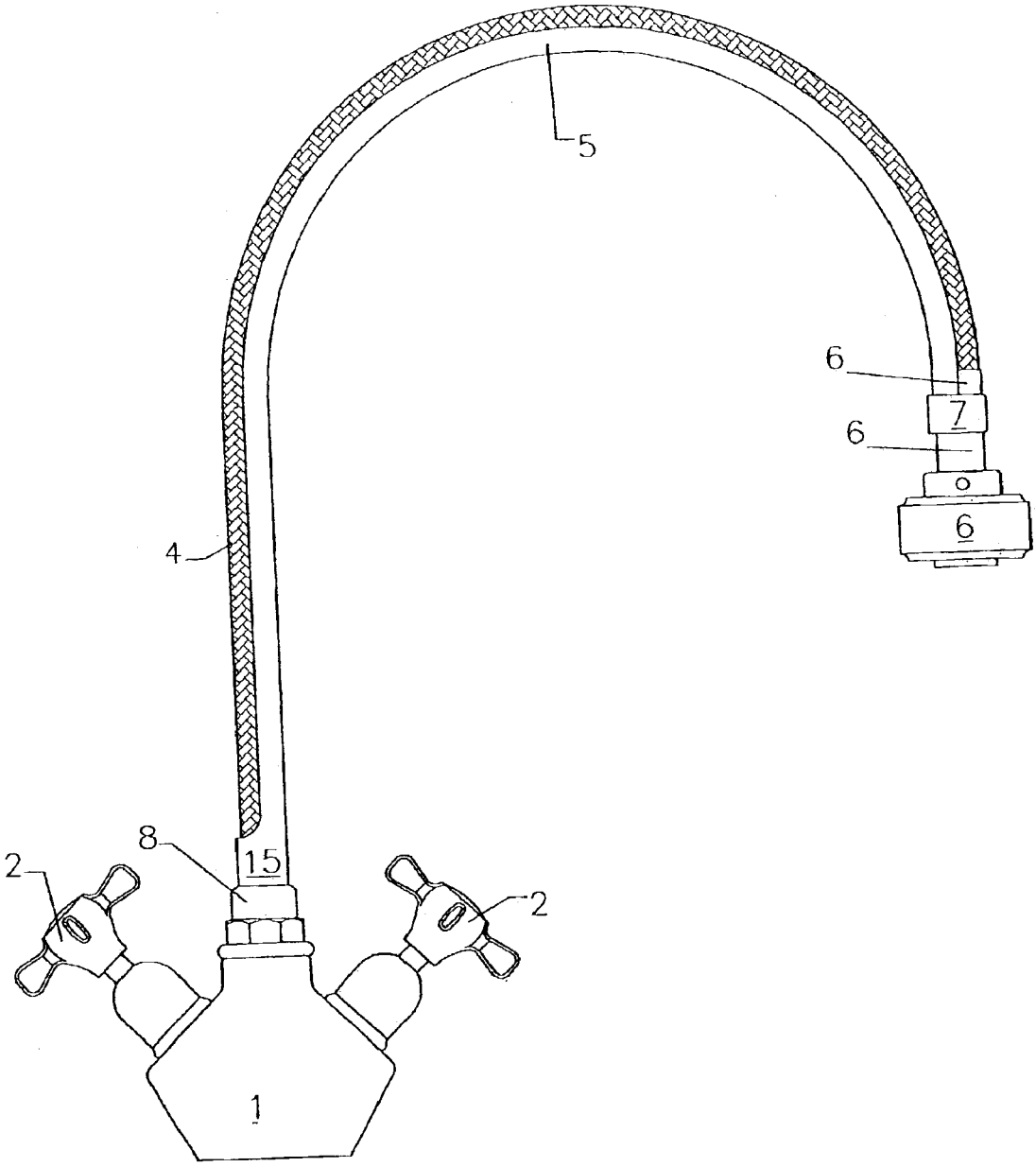
FIG. 2 is a deck mounted tap.

FIG. 2 shows a deck mounted embodiment of the tap. The configuration of the flexible hose (4), support (5), rigid head (6), clip (7) and pivot (8) is the same as in FIG. 1, and its operation by the user is essentially the same. The deck mounted embodiment differs in shape of the body (1) from the arrangement of FIG. 1 but is otherwise similar to that embodiment. Two internal valves are connected to the handles (2). Pipes for hot and cold water would approach the two valves from below in FIG. 2.

Figure 3:
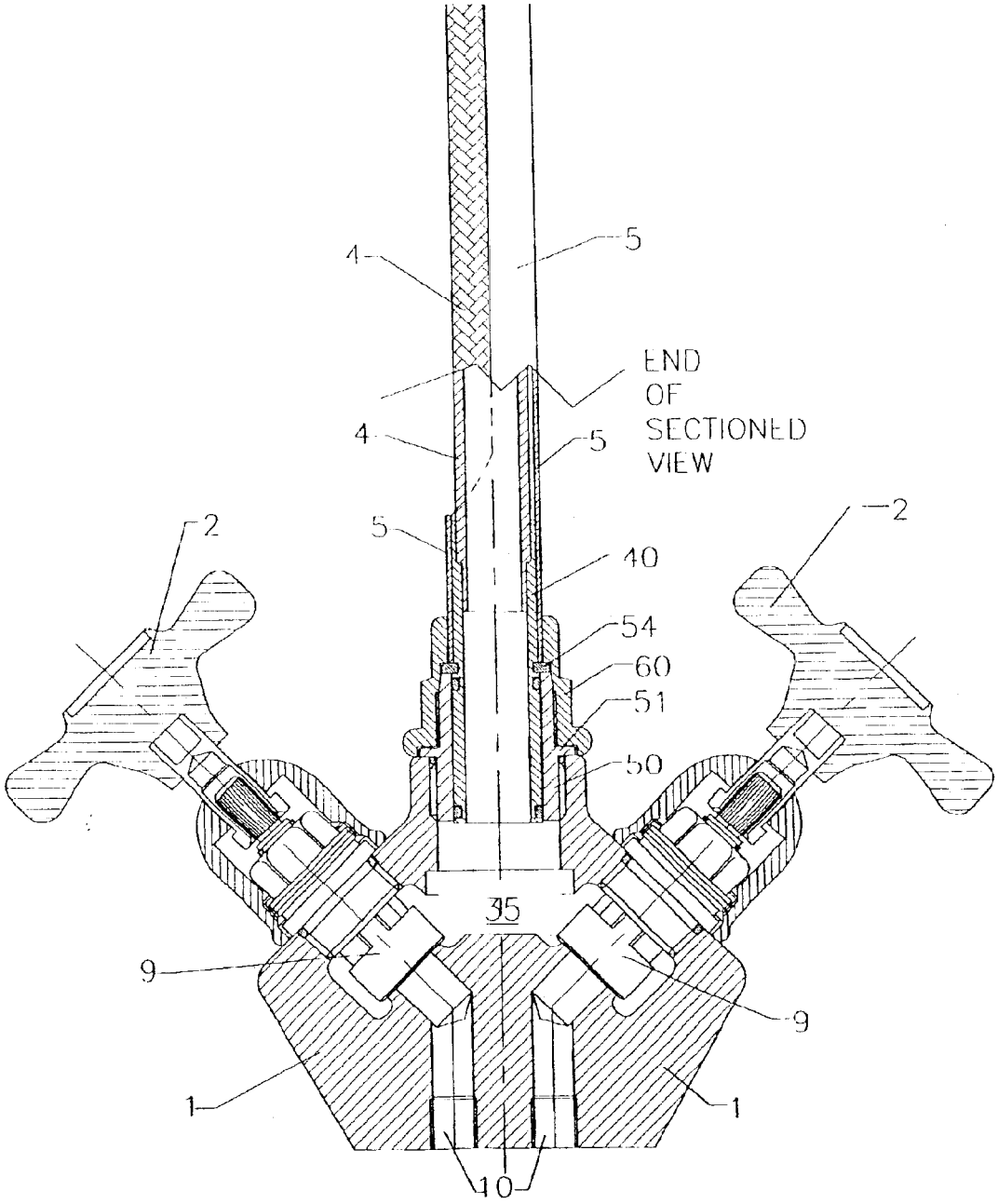
FIG. 3 is a cross sectional view through the tap of FIG. 2.

FIG. 3 shows a vertical cross section through the body (1), handles (2) and pivot (8) of the tap shown in FIG. 2. The mixing chamber (35) and the valves (9) are visible in cross section inside the body (1). Two pipes (10) which would normally carry hot and cold water respectively, enter the body (1) from below and approach the valves (9). Each valve comprises a pair of ceramic plates. The first plate is fixed to a valve body which is fixed relative to body (1), and the second plate is connected to the handle and lies over the first plate. Each plate contains a hole or holes through which water from the pipe must pass in order to flow through the valve to the mixing chamber. Turning the second plate while the first remains fixed alters the alignment of the holes and thus varies the size of the opening through which the water can pass. The valve is opened and closed by turning the handle to turn the second plate.

Turning the handle in one direction opens the valve, allowing more water to flow the more the handle is turned, while turning the handle in the other direction returns the valve to the closed position, in which there is no alignment between the holes so no water can pass. The amount of hot and cold water respectively entering the water chamber (35) through the valves (9) is thus regulated by turning the two handles (2). Hot and cold water are mixed in the chamber (35) and exit at the top through the flexible hose (4).

The flexible hose (4) and support (5) are attached to the body by a pivot composed of three concentric rings—an inner ring (40), a middle ring (50) and an outer ring (60). Water flows from the water chamber (35), through the inner ring (40) and into the hose (4).

The outer ring (60) and middle ring (50) are secured together to form a single unit that is fixed relative to the body (1). The outer ring (60) may have a part (see FIG. 2) which is in the form of a nut. The inner and middle rings (40, 50) extend into the tap body (1) past the point where the body (1) and outer ring (60) meet. A side projection (51) around the outer circumference of the middle ring (50) fits into a groove where the body meets the outer ring (60). The inner ring (40) can rotate within the outer and middle rings (50 and 60).

The inner ring (40) partially extends between the end of the flexible hose (4) and the support (5). The inner ring (40), flexible hose (4) and support (5) are fixed together and rotate as one body.

The tubular end of the support (5) extends beyond the end of the flexible hose (4) and between the inner and outer rings (40, 60), which overlap the middle ring (50). A side projection (54) around the circumference of the inner ring (40) projects into the gap between the end of the support (5) and the end of the middle ring (50). The side projection (54) allows rotation of the inner ring (40) relative to the middle ring (50), outer ring (60) and body (1), but prevents movement along the axis of rotation by stopping the inner ring (40) from being slid out of the middle and outer rings (50 and 60). This prevents the hose (4) and support (5) from being pulled out of the body (1) or pushed further into it in the assembled position.

Thus, the support (5) and the flexible hose (4) within it may be pivoted about a central vertical axis at the body (1). This permits the user to rotate the support out of the way, or to re-direct the flow of water within an arc defined by the shape of the support.

Figure 4:
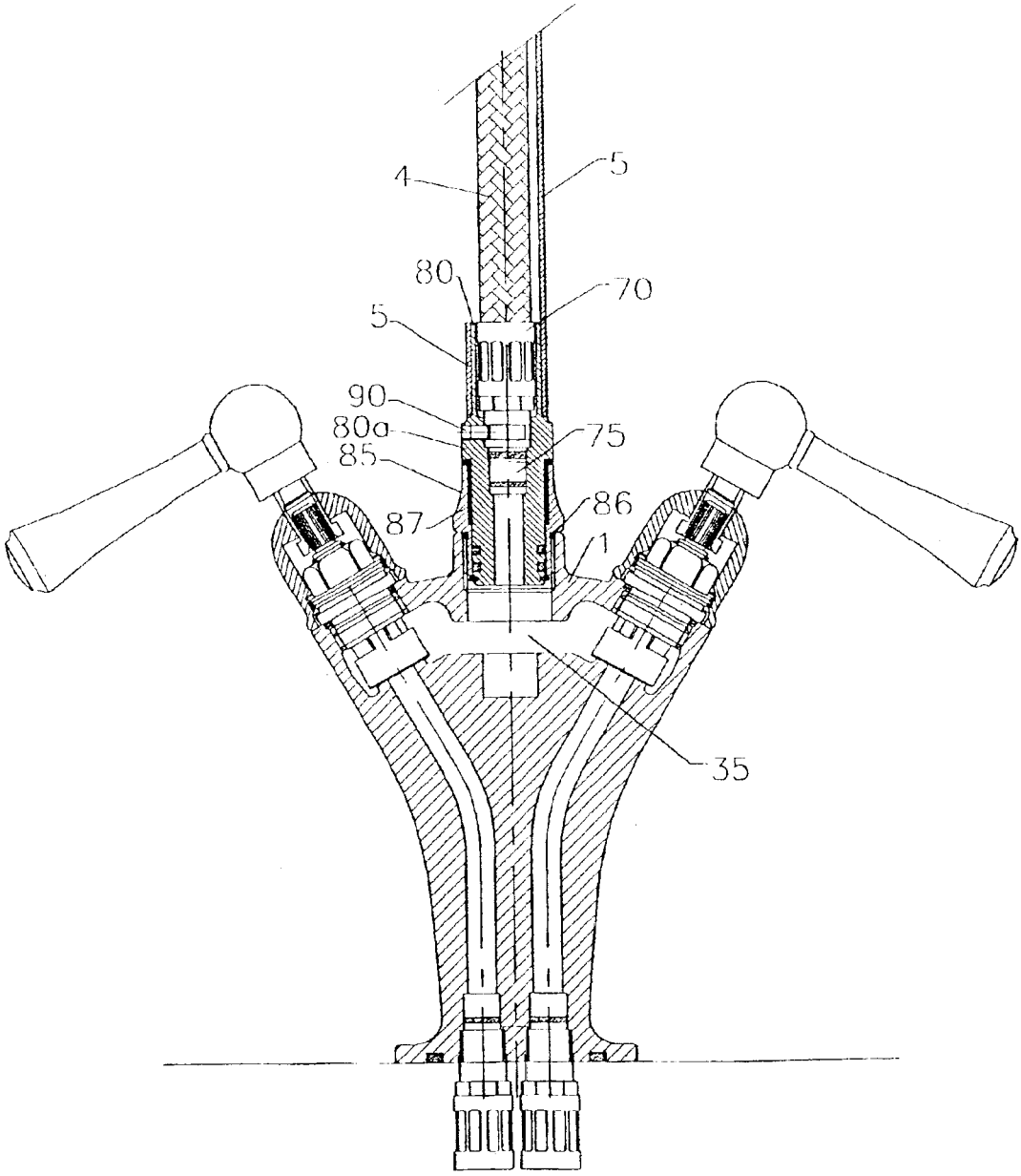
FIG. 4 is a cross sectional view through an alternative design for a deck mounted tap.

The embodiment of FIG. 4 shows an alternative design for the deck-mounted tap. This embodiment is essentially the same as that of FIGS. 2 and 3 except for the connection of the tap body to the flexible hose and the support.

As shown in FIG. 4, the tap end of the flexible hose 4 is crimped into tubular metal housing 70 which has a check valve 75 fitted at one end. The check valve 75 is a non-return valve and prevents water from flowing back into the body of the tap 1, once it has passed into the flexible hose 4.

Usually the check valve 75 works on a pressure principle, so that it automatically closes when the pressure on the hose side of the valve is greater than the pressure on the tap side of the valve.

The mixing chamber 35 of the tap is in fluid communication with the check valve 75. In this embodiment the fluid communication is via an internal conduit of another generally tubular member 80 which receives the check valve 75. Two-rings surround the check valve and prevent water from leaking out around its circumference. Thus, when the tap is in use, water passes from the mixing chamber 35, through the internal conduit of tubular member 80, through the check valve 75 and into the flexible hose 4.

An aperture in the top of the tap body 1 is provided with a screw thread. A lower depending portion of an annular member 85 screws into the aperture. The upper part of annular member 85 extends upwardly of the aperture and is provided with a flange which abuts against the tap body 1 surrounding the aperture, to aid location of the annular member 85 and to prevent it from being screwed too far into the aperture.

An annular plastic bearing 87 with an L shaped cross-section sits on top of and extends into the internal conduit of annular member 85. Generally tube shaped member 80 sits on top of the plastic bearing 87 and extends into the channel. Generally tube shaped member 80 has a central flange 80*a* which rests on top of the plastic bearing 87 and prevents it from falling into the channel.

An upper part of the tubular member 80 extends upwardly from the flange portion 80*a* and receives the metal housing 70 at the end of the flexible tube 4. The tubular member 80 is provided with a screw-hole, just above its flange 80*a*, for receiving a grub screw 90 that holds the metal housing 70 and hose 4 in place. The support 5 is friction fitted over the upper end of the tubular member 80. The provision of the plastic bearing 87 enables the support and generally tube shaped member (which are friction fitted together) to rotate relative to the tap body 1 and annular member 85.

Embodiments of the present invention have been described by away of example only. Modifications of these embodiments, further embodiments and modifications thereof will be apparent to a person skilled in the art. As such, it is intended that these lie within the scope of the invention.

What is claimed is:

1. A tap comprising:

a body having a fluid flow path therethrough;

at least one valve for regulating the flow of fluid through said body;

a flexible hose that communicates with said fluid flow path; and a support comprising a channel, said channel having an open mouth along its length;

said flexible hose being removably mounted in said channel of the support such that said flexible hose is supported along at least the majority of the length of said flexible hose by said support and said flexible hose is liftable out of said open mouth to remove it from said channel.

2. A tap according to claim 1, wherein said support extends along the substantial majority of said flexible hose.

3. A kit of parts for making a tap, the kit comprising:

a body having a fluid flow path therethrough;

at least one valve for regulating the flow of fluid through the body;

a flexible hose attachable to said body to communicate with said fluid flow path; and a support comprising a channel; said channel having an open mouth along its length;

said flexible hose being removably mountable in said channel of said support such that said hose is supported along at least the majority of the length of said hose by said support and said hose is liftable out of said mouth to remove it from said channel.

* * * * *